United States Patent [19]

Belvederi

[11] Patent Number: 4,535,693

[45] Date of Patent: Aug. 20, 1985

[54] DEVICE FOR DISPENSING VISCOUS MATERIALS

[75] Inventor: Bruno Belvederi, S. Martino di Monte S. Pietro, Italy

[73] Assignee: G.D. Societa per Azioni, Bologna, Italy

[21] Appl. No.: 516,326

[22] Filed: Jul. 22, 1983

[30] Foreign Application Priority Data

Sep. 8, 1982 [IT] Italy ..... 3526 A/82

[51] Int. Cl.[3] ..... B41F 31/08

[52] U.S. Cl. ..... 101/366; 101/DIG. 24

[58] Field of Search ..... 101/366, DIG. 24; 417/63

[56] References Cited

U.S. PATENT DOCUMENTS

| | | | |
|---|---|---|---|
| 637,577 | 11/1899 | Hett | 101/366 X |
| 2,065,279 | 12/1936 | Kline | 101/366 X |
| 3,090,302 | 5/1963 | Johnson | 101/366 X |
| 3,345,943 | 10/1967 | Rakowicz et al. . | |
| 3,541,959 | 11/1970 | Taffel et al. | 101/366 X |
| 3,667,500 | 6/1972 | Stone | 101/DIG. 24 |
| 4,064,801 | 12/1977 | Switall | 101/366 X |
| 4,277,226 | 7/1981 | Archibald | 417/63 X |

FOREIGN PATENT DOCUMENTS

| | | | |
|---|---|---|---|
| 2944322 | 5/1981 | Fed. Rep. of Germany | 101/DIG. 24 |
| 2444300 | 8/1980 | France | 101/DIG. 24 |
| 888906 | 2/1962 | United Kingdom . | |
| 897274 | 5/1962 | United Kingdom . | |
| 931466 | 7/1963 | United Kingdom . | |
| 1559687 | 1/1980 | United Kingdom . | |
| 2092945A | 8/1982 | United Kingdom . | |
| 2042941B | 4/1983 | United Kingdom . | |

*Primary Examiner*—Edgar S. Burr
*Assistant Examiner*—John A. Weresh
*Attorney, Agent, or Firm*—Cushman, Darby & Cushman

[57] ABSTRACT

Disclosed herein is a device for dispensing viscous materials, in which an air tight container is provided with a first pipe connecting the inside thereof to a nozzle for supplying the material to a consumption area, and with a second pipe for connecting the inside thereof to a line connected, with the interposition of an air flow regulator, to a source of compressed air.

Means are provided for fixing, inside the container, a pre-prepared cartridge of viscous material, placed with a low aperture in communication with the first pipe and communicating via an upper aperture with the second pipe.

3 Claims, 1 Drawing Figure

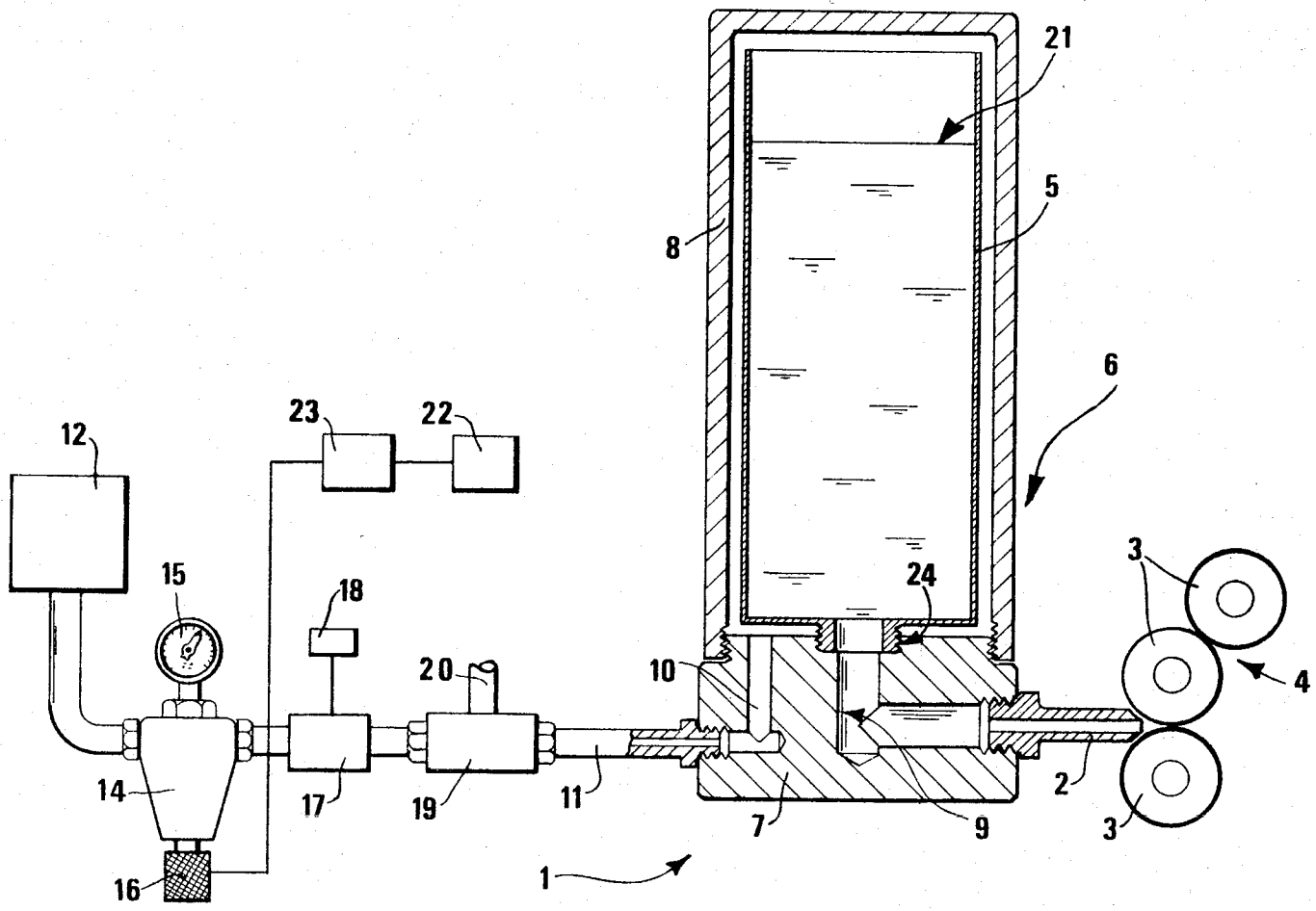
1
2
3
3
4
5
6
7
8
9
10
11
12
14
15
16
17
18
19
20
21
22
23
24

DEVICE FOR DISPENSING VISCOUS MATERIALS

BACKGROUND OF THE INVENTION

The invention relates to a device for dispensing viscous materials such as, for example, glue, printing ink and the like, that have to be supplied in determinate quantities onto surfaces, spreader rollers in particular, in thin film form.

More specifically, the invention relates to devices for dispensing ink to printing groups employed for placing decorative borders and/or repetitive wording on wrapping and tissue paper etcetera, wherein for this purpose use is made of extremely concentrated inks.

DESCRIPTION OF THE PRIOR ART

Devices of the above mentioned type are known in which a mass of ink present inside a container is progressively compelled, by mechanical means that exert a direct effect thereon, to flow towards an outlet nozzle in communication with a printing group.

In U.S. Pat. No. 3,345,943, for example, the said mechanical means are constituted by a piston that is hermetically assembled inside the said container and, with intermittent motion, slides axially there along.

With devices of the said type, however, a continuous type variation in the outgoing flow is not possible, nor are they suitable for micrometrically regulating the quantity of ink delivered. A fast, accurate, response to flow variation control instructions is obstructed because of the elastic deformation the container undergoes on account of the pressure in the inside thereof which, in a transient period that is not negligible, renders imperfect any regulation effected by modifying the displacement speed of the said piston. Furthermore, because of the said deformation, the delivery of the ink does not cease immediately every time the devices in question are taken out of operation: in fact, the walls of the container continue to act in an elastic manner on the viscous material present, thereby causing a partial overflow of the said material even after the said piston is at a standstill.

In conclusion of the description of the prior art, it should be noted that the said mechanical means that exert a direct effect on the ink, cause the maintenance and the periodical cleaning of the said devices to be laborious.

SUMMARY OF THE INVENTION

The object of the invention is to make available a device of the aforementioned type that is free from the problems described above.

This object is achieved with the device according to the invention for dispensing viscous materials, comprising: an air tight container, a first pipe connecting the inside thereof to a nozzle for supplying the material to a consumption area, a second pipe for connecting the inside thereof to a line connected, with the interposition of an air flow regulator, to a source of compressed air, and means for fixing, inside the said container, a cartridge of viscous material, placed with a low aperture in the region of the inlet of the said first pipe and communicating, via an upper aperture, with the said second pipe.

BRIEF DESCRIPTION OF THE DRAWINGS

Further characteristics and advantages of the device forming the subject of the invention will become more apparent from the detailed description that follows, illustrated purely as an unlimited example on the one accompanying FIGURE, in which the dispensing device in question is shown diagrammatically.

DESCRIPTION OF THE PREFERRED EMBODIMENT

With reference to the accompanying FIGURE, at 1 has been shown in longitudinal section a device for dispensing viscous materials, suited in particular to be utilized as an inking device for supplying, through a nozzle 2, concentrated ink to the inking rollers 3 of a printing group or consumption area 4.

The said ink is contained in a cartridge 5 placed in the inside of an air tight container 6, the latter constituted by a lower body 7 and an upper cover 8. The said cartridge 5 is rendered integral with the body 7 through fixing means constituted by a coupling 24 of the type provided with a male and a female thread.

The body 7 is provided with an outlet pipe 9 that connects the cartridge 5 to the said nozzle 2, and with an inlet pipe 10 that runs into the inside of the said cover 8 and, via a line 11, is connected to a source of compressed air 12.

Starting at the compressed air source 12, inserted in the line 11 there is a flow regulator 14 provided with an adjusting knob 16 and a pressure gage 15, a flow control element 17 connected to an alarm device 18 and, to conclude, a valve 19 provided with an air relief pipe 20.

How the device described herein operates is explained below.

The air arriving from the source 12 reaches the inside of the cartridge 5 via the line 11, the pipe 10 and the space in between the cartridge 5 and the upper cover 8.

In this way, a determinate pressure is applied above the upper surface 21 of the ink. The said pressure, the value of which can be set, through the flow regulator 14, to suit the requirements, causes the ink to flow from the nozzle 2 in a given, variable, quantity for it to be supplied to the rollers 3.

Once the ink inside the cartridge 5 and, therefore, in the pipe 9 and the nozzle 2, has come to an end, a variation occurs in the flow of air inside the line 11, this being due to the fact that air passes freely through the nozzle 2. The said flow variation is detected by the control element 17 which, by setting the alarm 18 in operation, draws the attention of the operator to the cartridge 5 being empty.

The replacement of the empty cartridge 5 with a new cartridge is effected after the air coming from the source 12 has been bypassed, through the valve 19, into the relief pipe 20.

It should be noted that the operation of the knob 16, in order to adjust the flow of air along the line 11 and, therefore, the flow of the ink into the nozzle 2, can either be effected manually by the operator, after a visual check on the quality of the print has been made, or alternatively it can be performed automatically by a servomotor group 23 interlocked to an optical-type sensor element 22 with which to verify the quality of the print.

In the practical embodiment of the invention, the device can differ in form from that described above and, in particular, numerous modifications of a practical nature may be made thereto without, because of this, there being any deviation from the framework of protection afforded to the invention.

What is claimed is:

1. A device for dispensing viscous material, comprising:

an airtight container;

a first pipe connecting the inside of said airtight container to a nozzle for supplying the viscous material to a consumption area;

a second pipe for connecting the inside of said airtight container to a line connected, with the interposition of an air flow regulator, to a source of compressed air;

means for fixing, inside said container, a cartridge containing viscous material said cartridge having a low aperature at the bottom of said cartridge and an upper aperature located above the uppermost level of said viscous material, said low aperature being adjacent and communicating with the inlet of said first pipe said upper aperature being in communication with said second pipe, whereby, air from said second pipe forcing said viscous material through said nozzle and exiting through said nozzle when the supply of viscous material has been exhausted;

a flow control element interposed in said line and connected to an alarm device so as to set such alarm in operation upon sensing that air is passing directly from the said source to the said nozzle because said cartridge has become depleted of said viscous material.

2. The device of claim 1, further including;

an adjuster for said air flow regulator;

an optical sensor constructed and arranged to sense at said consumption area a characteristic indicative of quality of the viscous material being supplied by said device;

a servomotor means operatively connected between said optical sensor and said adjuster for automatically adjusting said flow regulator in response to sensing by said sensor.

3. The device of claim 1, further including:

a valve incorporated in said line upstream of said container and connected with a relief pipe for bypassing compressed air from said source towards said relief pipe.

* * * * *